United States Patent [19]

Baulard-Cogan

[11] 3,959,919

[45] June 1, 1976

[54] ANIMATED OBJECTS SUCH AS DOLLS, FIGURED PERSONAGES AND THE LIKE

[75] Inventor: Raymond Gerard Baulard-Cogan, Louveciennes, France

[73] Assignee: Agence Nationale de Valorisation de la Recherche (ANVAR), Neuilly-sur-Seine

[22] Filed: Dec. 23, 1974

[21] Appl. No.: 535,665

Related U.S. Application Data

[62] Division of Ser. No. 443,505, Feb. 19, 1974, Pat. No. 3,881,275.

[52] U.S. Cl. ..... 46/135 R; 46/141

[51] Int. Cl.[2] ..... A63H 13/02

[58] Field of Search ..... 46/135 R, 141, 118, 46/119

[56] References Cited

UNITED STATES PATENTS

| | | | |
|---|---|---|---|
| 1,974,366 | 9/1934 | Pollock | 46/135 R |
| 1,978,337 | 10/1934 | Bowers | 46/135 R |
| 2,811,810 | 11/1957 | Ostrander | 46/141 X |
| 2,888,777 | 6/1959 | Kaplan | 46/141 X |
| 3,153,881 | 10/1964 | Baulard-Cogan | 46/135 R X |
| 3,745,696 | 7/1973 | Sapkus et al. | 46/141 X |

*Primary Examiner*—F. Barry Shay

[57] ABSTRACT

An animated doll comprising a deformable flexible envelope mounted on a rigid casing filling the greater part of the head and trunk portions of the doll. The mouth of the doll is moved by actuating means causing nursing of the doll and permitting absorption and excretion of liquid.

4 Claims, 5 Drawing Figures

ANIMATED OBJECTS SUCH AS DOLLS, FIGURED PERSONAGES AND THE LIKE

The present application is a division of my previous application Ser. No. 443,505 filed on Feb. 19, 1974, now U.S. Pat. No. 3,881,275, and generally relates to animated objects in the form, for example, of dolls, figured personages, creatures including animals, toys and the like wherein is mounted an animating device for controlling, operating or effecting diverse movements and/or deformations of said object. For purpose of disclosure the animated object will take the form of a doll.

The application relates in particular to an animated object in the form of a doll which includes structure for generally moving the mouth of the doll, including nursing movements for liquid intake and for ultimate excretion.

According to my earlier application an object embodied in the form of a doll is provided which comprises casings for the trunk and head portions of the doll. For moving various parts of the doll such as the eyes, arms and lips a control rod is provided which has at an end thereof in the trunk casing a ponderable ball-like member serving as a counterweight and effecting free sliding and rotary movements of the rod in a swivel bearing fixedly mounted in the body of the doll. Actuating means are provided and rendered operative by the rod when moved by the counterweight for in turn moving parts of the doll to which the actuating means are connected.

According to the present application the animated object, in form of a doll, comprises a body having movable and deformable members, each of which is connected with a respective actuating means, the body of the doll having an envelope moulded from a deformable flexible material applied over a hollow casing of substantially rigid, non-deformable material, the casing enclosing the greater part of the head and trunk portions of the doll. For moving the mouth of the doll an actuating member is provided which comprises a lever mounted in the hollow casing in the head portion of the doll. An end of the lever is advantageously anchored in the deformable flexible part of said envelope forming the chin of said doll while the other end of the lever is connected to actuating means for the moving of the lever and in turn the mouth. Thus, by operating the actuating means one can effect opening and closing movements of the mouth.

The lever may advantageously be in form of an L-shaped fish-hook to facilitate gripping at one of its ends the deformable flexible chin part of the doll, the other end of said fish-hook being operated by the actuating means for mouth movement.

The tongue of the doll is preferably in the form of a hollow pear-shaped bulb moulded from elastic material and housed within the buccal cavity of the doll which has a cup-like lower configuration. A hole is advantageously formed in the lower wall of said pear-shaped bulb of the tongue, the latter communicating at its elongated rear end with an ingestion tube which communicates with a bladder-like pocket. By this manner automatic nursing of the doll is obtained when said actuating means are operated.

The lever actuating means comprises a movable ponderable ball-like member mounted for movement inside the hollow space of the doll trunk, the ball-like member being mounted as a counterweight at one end of a rod, which is freely slidable and rotatable in a swivel bearing fixedly mounted between the head and trunk portions of the doll within the doll casing. The end of said rod which moves in the head portion is connected by suitable linkages, wires, guide pulleys and the like to the lever which moves the mouth. With the described structure one may automatically produce mouth movements and mouth deformations and simultaneously nursing of the doll, while controlling movements of other members of the doll as described in my earlier application Ser. No. 443,505.

The invention will be better understood and further objects, details and advantages thereof will appear from the following disclosure taken in conjunction with the accompanying drawings which illustrate two embodiments of the invention as applied to a doll. In the accompanying drawings.

Figure 1:
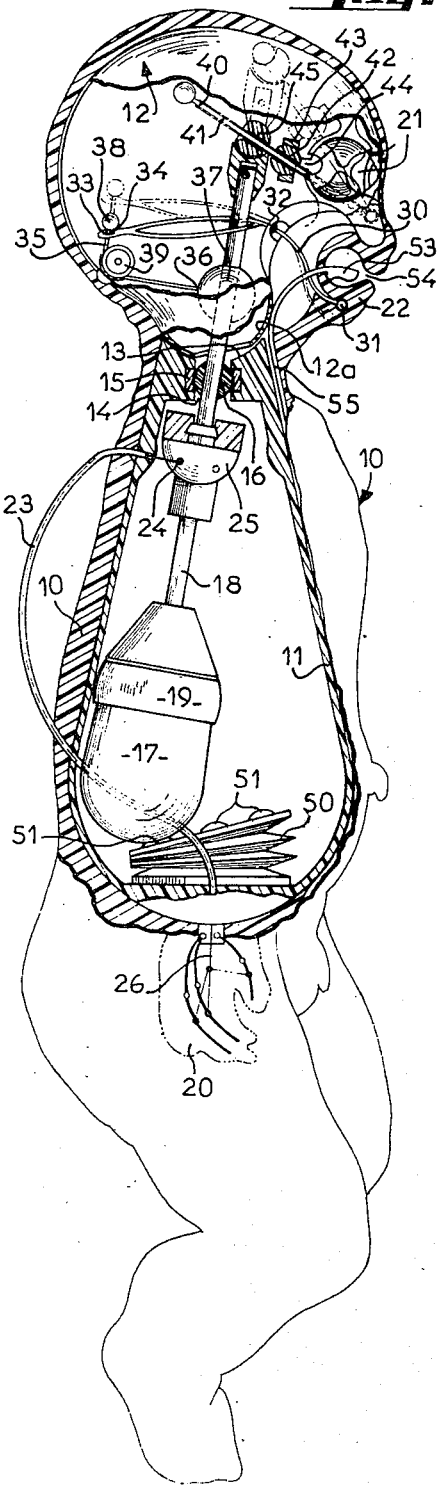
FIGS. 1 and 2, show the doll in section with parts broken away in slightly different operating positions.
Figure 2:
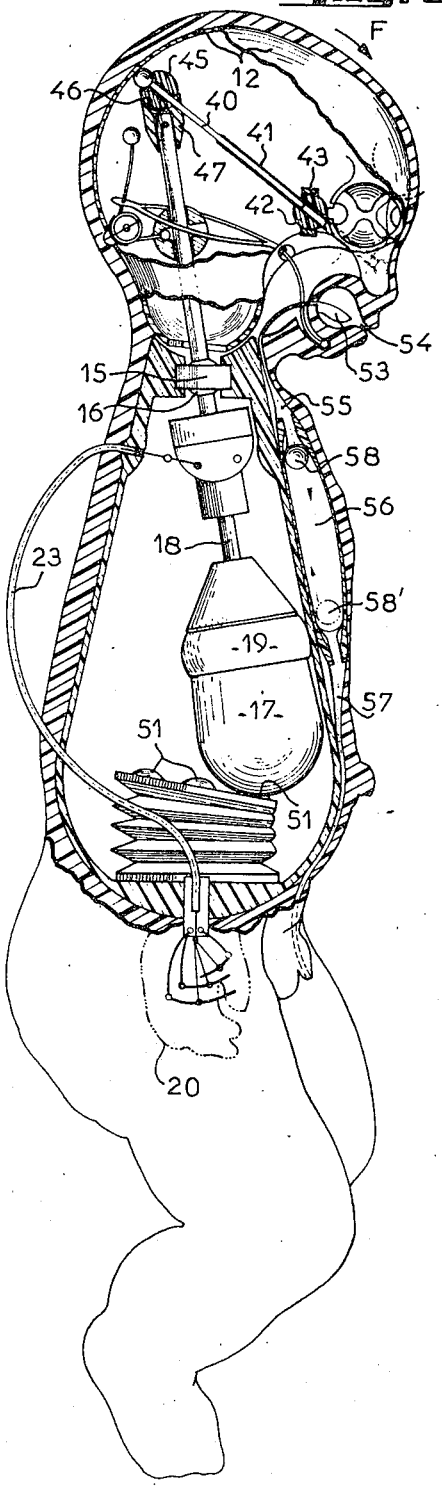

According to the form of embodiment shown in FIGS. 1 and 2, a doll in form of a new-born child comprises a body 10 moulded from a flexible deformable material cast over two rigid casings, one 11 of which is mounted within the trunk portion of the doll and the other 12 in the form of a skull mounted within the head portion of the doll. These casings may be made from any suitable material, desirably from plastics or like synthetic material of a sufficiently rigid or stiff grade. The casing 12 is pivotally mounted by means of a swivel or ball-and-socket joint with its base 12*a* rotatable within a cradle or like bearing or socket portion 13 formed at the upper portion of the casing 11. The casing 11 is generally of frusto-conical configuration having at its top portion an opening forming a neck or throat portion 14 of reduced diameter in which the swivel or ball-and-socket joint 16 is rotatably mounted in a bushing in form of a cup or socket-like bearing 15.

In the casing 11 is mounted a ponderable ball made for instance from steel or lead 17 which is secured at the end of a lever 18 which may consist for instance of a steel rod. The counterweight 17 may be encompassed at least in part by a collar or ring 19 made from rubber or the like which will damp or absorb the shocks of the counterweight within the casing 11.

The rod 18 is mounted within the ball joint 16 so as to be freely rotatable and slidable and it projects at its other end into the casing 12 of the skull.

The different pivotally connected organs or members of the doll such for instance as the hands 20, the eyes 21, the lower jaw 22, etc., are actuated by operating mechanisms having sheathed cables, links and levers, etc., which are appropriately connected to the rod 18 adapted to set parts of the object into motion.

Thus for instance a cable 23 under sheathing may be seen which enables actuation of the hand 20. The cable 23 is accommodated within the body of the doll (it has been shown externally for ease of illustration). One end of the cable 24 which extends from the sheath is secured to a ring or collar 25 which is slipped over the rod 18 on which it may freely rotate and slide. The other end 26 of the cable extends down to the fingers of the hand. When the end 24 of the cable is pulled as shown in FIG. 2, the fingers of the hand are operated in the closing direction, the closing action being strong because the force exerted is multiplied by the length of the lever arm, the cable 24 being secured close to the point of pivotal connection of the ball joint 16. A cable 23 is of course provided for each hand of the doll.

In the illustrated embodiment, the actuation of the mouth and more specifically of the lower jaw 22 is effected by lever 30 pivotally connected at 31 in the jaw and guided at 32 within an orifice, forming a bearing, provided in the stiff skull 12. The other end 33 of the lever is formed with a hole 34 through which passes a small string 35 one end 36 of which is secured to a ring-shaped collar 37, which is slidable on the rod 18, and the other end of which carries a ball 38 large enought to prevent the small string from passing through the hole 34, as will be seen in FIG. 1. A guide pulley 39 for the small string 35 is fastened to the skull.

According to the position of the counterweight 17, i.e. of the lever or rod 18 within the body of the doll, the lever 30 is either pulled (FIG. 1) to move the mouth toward its closing direction or is released leaving the mouth in the normal half-open as-moulded position. In FIG. 2, the lever 30 is not actuated by string 35 but the mouth is nevertheless closed since the skull 12 has been turned forward in the direction of the arrow F on the casing 11.

In the embodiment shown in the drawings, the movement of the eyes is obtained by a lever consisting of two parts 40, 41 sliding relative to or telescoping within each other and which extends through a ball-and-socket joint 42 which is secured to a bar 43 to which each one of both eyes is fastened through a backward projection 44 integral with the eye-ball. The lever 40, 41 slides within a ball-and-socket joint 45 which may consist for instance of a magnetic ball which tends normally to extend into a cradle or socket 46 also of magnetic character of a member 47 mounted endwise of the rod 18.

At the bottom of the casing 11 is provided a bellow 50 which is normally biased into extended position by an inner spring (not shown) or by equivalent means. On this bellow is provided a number of protrusions 51 which, when acted upon or squashed during movement of the counterweight 17, produce various sounds for simulating infant cries or wails.

According to the embodiment shown in the drawings a porous tongue 53 is mounted within the mouth 54 and it communicates with a duct 55 provided in a cavity 56 formed on the abdomen between the front wall of the vessel or shell 11 and the moulded body of the doll. The cavity 56 communicates with a lower portion of a urethra-like duct 57. A ball 58 is freely mounted within the cavity 56 for movement between an upper and a lower position. In FIG. 2 the lower position is shown at 58', whereat the ball closes or seals off the duct 57.

The doll is animated, as will be seen from the previous description under control of lever 18 the movement of which is itself under control of the counterweight 17. More specifically it will be appreciated that by virtue of the tilt imparted to the doll, the counterweight 17 assumes various positions within the casing 11 and that according to these positions various motions of various amplitudes and forces, are transmitted to different organs of the doll. At the same time various sounds are produced upon depressing protrusions 51 or bellow mechanism 50. In some tilted positions of the device the motions may be of great force. Thus, if the doll is rocked very powerful closing forces are transmitted to the hands so that the doll with its hands will cling to or grip the person holding the same. When it is rocked or dandled, the doll upon displacement of counterweight 17 will move its jaws and therefore its lips. It will be appreciated that alternate opening and closing of the mouth with accompanying lip action may be used for simulating sucking or feeding.

Some positions will enable urinating and others induce a response resembling sleep with gradual closing of the eyes. All the movements are attended by various sounds such as those emitted for instance by new-born babies. These functions are performed by the doll illustrated in FIGS. 3 to 5.

Figure 3:
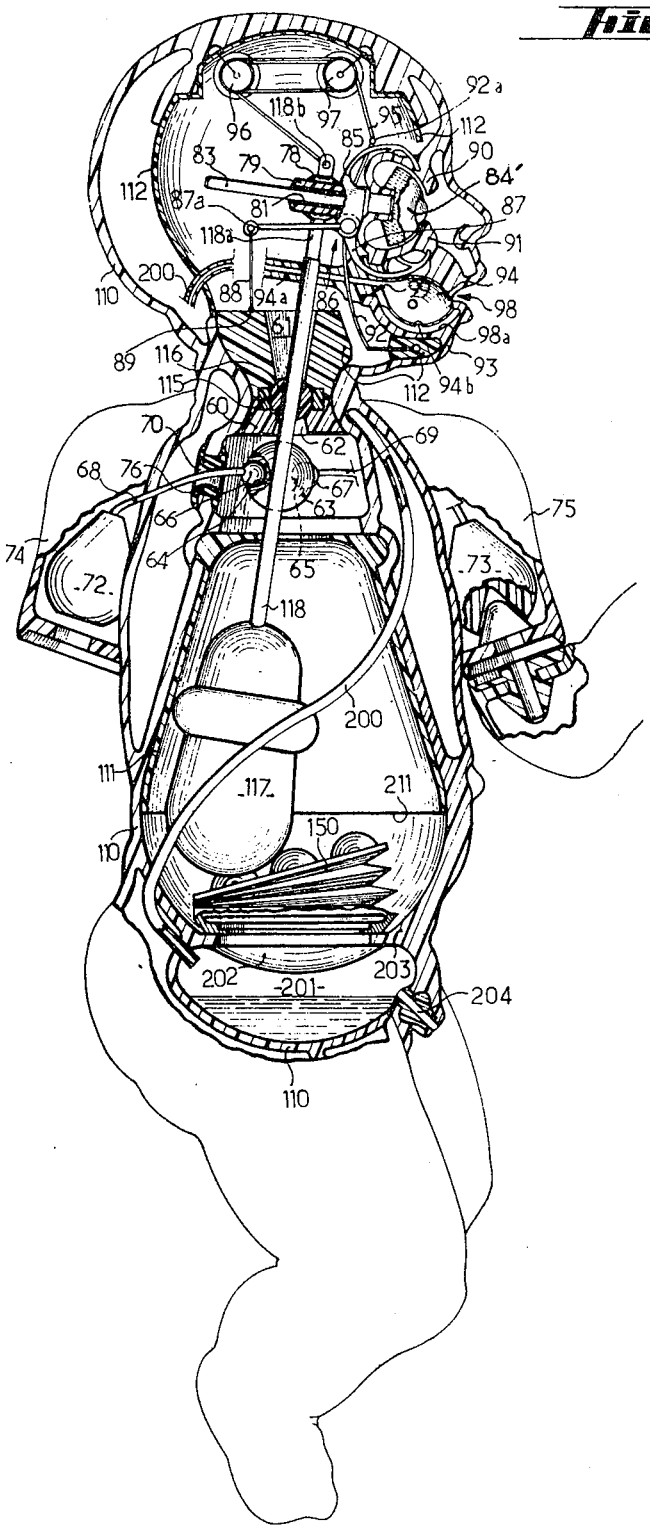
FIG. 3 is a section view of a doll of another embodiment of the invention.
Figure 4:
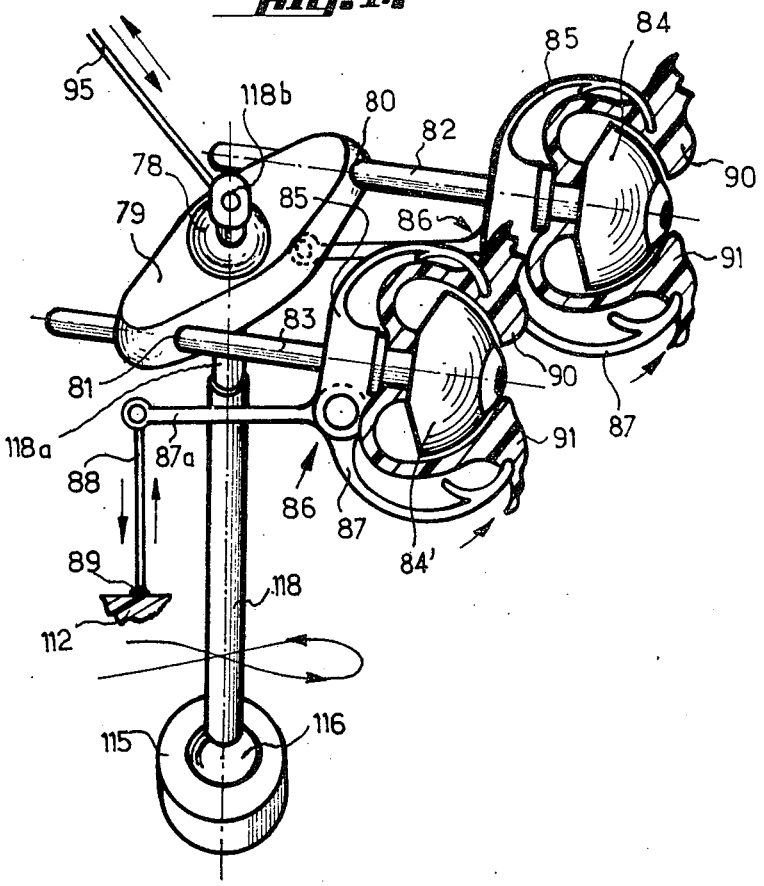
FIG. 4 is a detailed view showing the control mechanism for actuating the eyes of the doll illustrated in FIG. 3 and showing a detail of the connection of the actuating means for moving the mouth.
Figure 5:
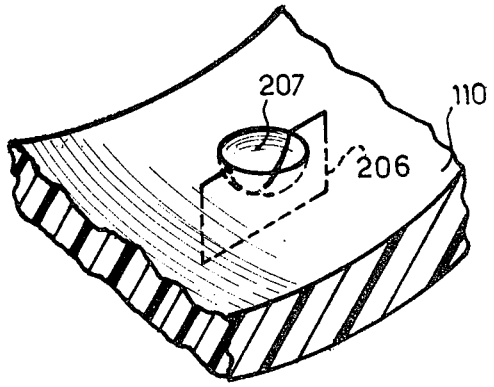
FIG. 5 is a sectional fragmentary view showing an anatomical detail.

According to the embodiment of FIGS. 3 to 5 wherein the same reference numerals increased by one hundred units are used to denote the organs of the animated doll similar to those illustrated by FIGS. 1 and 2, a doll is shown which comprises a body defined by an envelope 110 moulded from deformable flexible material for example rubber-like material cast over two rigid casings. One casing 111 is mounted within the trunk of the doll while the other casing 112 forms a skull mounted within the head. As in FIGS. 1 and 2 these casings may be made from any suitable material, desirably of plastics or synthetic material of a sufficiently rigid or stiff character. As seen in FIG. 3, both casings are held in spaced relation to one another by the envelope 110 of the body of the doll which is moulded over these two casings. The flexibility of the envelope 110 provides some freedom of motion to the head with respect to the trunk.

At the bottom of the skull 112 is fitted an element 60 secured below the skull by any suitable means such as screwing or welding. Between the element 60 and the bottom of the skull 112 there is accommodated a socket bearing 115 for a ball joint 116 which freely rotates within the socket. As in the embodiment of FIGS. 1 and 2, a rod 118 is mounted for free rotation and free sliding movement within the ball joint 116 and projects at one end thereof into the skull 112 and being connected at its other end to a ponderable ball 117 forming a counterweight.

To damp or absorb the shocks of the ball 117, there are provided in this embodiment two frustums of a cone 61, 62 formed in the skull 112 and in the element 60, respectively, each cone being formed with a passage shaped to limit angular displacement of the rod 118.

According to the instant embodiment the actuation of the arms is provided by a ball 63 slidably mounted on the rod 118 within the casing 111 of the trunk, said ball 63 comprising two bearing formations 64, 65 for accommodating two ball-and-socket joints 66, 67 provided at the free ends of two curved rockers or like swinging members 68, 69 freely extending within orifices (one of which is shown at 70) formed in the wall of the envelope 110 of the doll. The other ends of members 68, 69 are respectively connected to counterweights 72, 73 which respectively extend into hollow arm 74, 75 of the doll. It should be noted that the orifices are provided in the wall of the flexible envelope of the doll between casings 111, 112. Strengthening or reinforcing parts (one of which is shown at 76) may be provided as shown in FIG. 3.

Movement of the eyes is accomplished as will be appreciated from FIG. 4 which shows a mechanism comprising a swivel or ball-and-socket joint 78 which is slidably carried on an end portion of an elongate member 118, of reduced diameter compared to the rod 118 from which it extends; on the ball joint 78 is pivotally connected a balanced rocker or like swinging lever 79 at each end of which are formed two bores 80, 81 for the free sliding motions of both rods 82, 83 connected to the irises 84, 84', respectively, of the eyes. Each lever 82, 83 has mounted thereon a like mechanism comprising a fork 86 constituted of arms 85 and 87, the latter being pivotally connected to the former and having an extension 87*a*, secured, for example, by a small string 88 at a stationary fastening point 89 of the skull. Both arms of the fork 86 are shaped to encompass or grip the eye coverings 90, 91 of the doll, which eye coverings are made from resiliently deformable material of the envelope 110 covering or lining the doll.

For actuating the mouth and the chin, there is provided a generally L-shaped member 92 which is hooked into the chin 93 of the doll and straddles the tongue 94. The fish-hook is operated at its upper portion where it is attached at 92*a* to a cable which is fitted, with possible gearing down over sheaves 96, 97, carried within the skull, and fixed at 118*b* at the end of the rod 118.

As to the tongue 94 the latter consists of a pear-shaped hollow bulb moulded for instance from rubber which is housed within the buccal cavity 98 formed as a recess in the envelope 110 of the doll. This cavity is interiorly closed in sealing or fluid-tight relationship except for a hole 99 for the passage of the rear end 94*a* of the tongue which opens into a connecting pipe 200 forming an ingestion tube and which leads with its other end to a bladder-like pocket 201 provided at the bottom of the trunk of the doll. The buccal cavity 98 exhibits a lower cup-like portion 98*a* on which the tongue 94 bears. The latter is formed at its lower portion with an orifice 94*b* which registers in confronting relationship with the hollow cup-like portion 98*a* of the buccal cavity. The mounting of the tongue is effected through force fitting and resilient locking of the rear end of the tongue into the hole 99. Such a mounting is fluid-tight.

The bladder-like pocket 201 at the bottom of the doll is closed towards the top by a plug 202 which engages an opening defined by a flange 203, the envelope 110 being reinforced in this region. The remainder of the pocket is defined by the envelope 110.

As seen in FIG. 3 the bladder-like pocket 201 communicates with the urethra 204.

At 150 is shown as in FIGS. 1 and 2 the bellow which produces sound when it is squeezed by the counterweight 117. In the instant mounting the bellow 150 is desirably secured onto the plug 202. The spring (not shown) which is mounted within the bellow 150 and which urges same to extended position is desirably calibrated so as to substantially counterbalance or offset the weight of the ponderable ball.

The assembly of the doll above described may be carried out very simply.

The ball 63 for operating the arms is slipped over the rod 118 after the assembly of the ball 117 and rod are mounted within lower casing 111 with ball 117 extending through opening 211 at the bottom of the casing 111. Then the control mechanism, for actuating the eyes and the chin, is operatively assembled within the skull 112 to the rod 118. The ball joint 116 and its socket or bearing 115 is then mounted on element 60 and the skull then placed as shown in FIG. 3. The connection of the tongue to the ingestion tube 200 is made whereafter the resilient body covering of the doll is applied which holds the parts, such as casings 111, 112, the legs and the shoulders in place. Obviously, the plug 202 and the bellow 150 will have been positioned within the envelope before it is applied. Also the tongue will have been mounted within the buccal cavity. Afterwards the rockers 68, 69 for operating the arms, are mounted together with their counterweights 72, 73 and then the fore arms and the hands are affixed for instance by means of simple resilient clips 73*a*, 73*b*.

All of the control mechanisms for actuating the various parts of the doll are operated by the counterweight 117 and as the control means are reversibly operable over predetermined limits they provide wide variations of movements.

The animations of the doll are therefore seen to be essentially a function of its positioning. The parts are so organized that in the supine position, the doll will give the appearance of sleeping because the eyes will be covered by the eyelids which are operated by forks 86 as previously described. The mouth in this position will be relaxed.

When the baby is sitting the eyes will be open and the mouth tends to close, not necessarily completely. When the baby is rocked in a position with the back of its head supported by one arm and its legs supported by the other arm of the person holding the doll, weight 117 will be moved angularly about its pivot 115, 116 from left to right as viewed in FIG. 3. In so doing the eyes will be moved in counter-direction giving thereby the appearance of the eyes following the person rocking the doll. The mouth is sucking when the baby is being rocked, dandled or swung. When a feeding-bottle is inserted into the mouth, the liquid is automatically sucked or drawn by the tongue into the mouth and the ingestion tube down to the bladder. In the standing position or in a position on the belly, the liquid contained within the bladder will flow out and exit through the urethra.

Grins and face deformations will be obtained in other positions. Sound will be produced by interaction of the bellow 150 with its inner spring when extended or with ball 117.

With the disclosed construction, taking into account the many mechanical parts used and the interaction therebetween, a large number of expressive facial and body movements may be obtained.

According to the detail modification illustrated by FIG. 5 in relation to a doll of the female sex, the urethra communicating with the bladder 201 will be reduced to a cut-out 206 made through the envelope 110 of the doll at the desired location in a reduced thickness portion of said envelope shaped by an inner moulding into a lenticular hollow recess 207 provided on the inner face of the envelope. With this construction, the pocket 201 will remain in closed sealing relationship except when the legs of the doll are spread apart, at which time, a substantially circular opening is obtained, enabling a jet of liquid to flow out when the bladder is full of liquid and the doll predeterminedly oriented.

It should be understood that the invention is not at all limited to the forms of embodiment shown and described herein which have been given by way of examples only, the invention including all the technical equivalents of the means described as well as their combinations if same are carried out in accordance with its gist and used within the scope of the appended claims.

What is claimed is:

1. An animated doll comprisng a body including first and second hollow casings formed of substantially rigid, nondeformable material respectively generally defining head and trunk portions of the doll and an envelope of deformable flexible material fitted over said hollow casings and defining a lower jaw and mouth of the doll, an actuating member for the mouth of the doll comprising a lever mounted in said head portion of said first casing one end of which is connected in the deformable flexible part of said envelope forming said lower jaw of said doll, and actuating means operatively connected to the other end of said lever for moving said lever and thereby the mouth of the doll and simultaneously other movable parts of the doll, said actuating means comprising a rod mounted slidably and rotatably between said head and trunk portions within said first and second casings and a movable ponderable ball-like member mounted for movement inside the hollow space of said trunk portion, said ball-like member being mounted as a counterweight at one end of said rod, the end of said rod which moves within said head portion being connected to said lever for moving said mouth upon movement of said rod by said ponderable ball-like member.

2. A doll according to claim 1, wherein said lever is a generally L-shaped member and wherein a tongue is positioned within the mouth of the doll, said mouth having a cup-shaped portion, said tongue comprising a hollow pear-shaped bulb moulded from elastic material having an aperture formed in the lower wall thereof, said tongue having an elongated rear end at which the interior of the tongue communicates with a passage of an ingestion tube which in turn communicates with a bladder-like pocket located in said doll trunk portion.

3. A doll according to claim 2, wherein the lower extremity of said second casing terminates in a flange having a central opening therein within the envelope of the doll, a plug member closing said flange opening, said bladder-like pocket having one wall thereof formed of the moulded envelope of said doll and to which is connected said ingestion tube from the tongue, and a urethra communicating with said bladder-like pocket.

4. A doll according to claim 3, wherein said doll is female sexed and the urethra thereof is in form of a cut-out through said doll at a predetermined location at a reduced thickness portion of said envelope.

* * * * *